US006119703A

United States Patent [19]

Santhouse et al.

[11] Patent Number: 6,119,703

[45] Date of Patent: Sep. 19, 2000

[54] HOOK TAPE TO PLASTIC ROLLER BODIES

[75] Inventors: Daniel Santhouse, Wilton; Vito James Carlucci, Stratford, both of Conn.; John Macula, Carteret, N.J.; R. Neil Tobin, Stamford; Roy Taylor, Stratford, both of Conn.

[73] Assignee: Conair Corporation, Stamford, Conn.

[21] Appl. No.: 09/092,416

[22] Filed: Jun. 5, 1998

[51] Int. Cl.[7] ..... A45D 2/14

[52] U.S. Cl. ..... 132/262

[58] Field of Search ..... 132/200, 210, 132/222, 223, 245, 247, 248, 250, 251, 253, 254, 262, 265, 268

[56] References Cited

U.S. PATENT DOCUMENTS

| | | | |
|---|---|---|---|
| 2,800,910 | 7/1957 | Seyffarth | 132/222 |
| 3,204,646 | 9/1965 | Chamberlin | 132/250 |
| 3,438,382 | 4/1969 | Solomon | 132/262 |
| 3,590,829 | 7/1971 | Parisi | 132/247 |
| 3,970,095 | 7/1976 | Prince et al. | 132/245 |
| 4,108,183 | 8/1978 | Mauro | 132/250 |
| 5,186,188 | 2/1993 | Fasolt | 132/245 |
| 5,538,021 | 7/1996 | Kim | 132/222 |
| 5,660,192 | 8/1997 | Kim | 132/223 |

*Primary Examiner*—Todd E. Manahan
*Assistant Examiner*—Eduardo C. Robert
*Attorney, Agent, or Firm*—Ohlandt, Greeley, Ruggiero & Perle

[57] ABSTRACT

The present invention is a roller comprising a roller body including a bore therein and a slot communicating between an exterior surface portion of the roller body and the bore. A hook tape is wrapped around the roller body and includes a first tape end and a second tape end. The first tape end and the second tape end extend into the bore through the slot. A key (e.g., a roller core) positioned in either the bore or the slot for clamping the first tape end and the second tape end to thereby prevent removal of the hook tape from the roller body. Alternatively, the roller body may include at least one pin extending from an exterior surface of the roller body. The hook tape is wrapped around the roller body, with the first tape end and the second tape end being secured to the pin to prevent removal of the hook tape from the roller body.

19 Claims, 9 Drawing Sheets

HOOK TAPE TO PLASTIC ROLLER BODIES

THE FIELD OF THE INVENTION

The present invention is related to a roller assembly with hook tape.

BACKGROUND OF THE PRESENT INVENTION

Hair roller assemblies are widely used to curl hair in a desired fashion or style. Some roller assemblies are known to include hook tape to secure hair to a roller body. The hook tape is typically connected to the roller body by welding the hook tape directly onto the roller body through the use of ultrasonic welding techniques. Although such welding techniques provide a reliable means for connecting hook tape to a roller body, they require a considerable investment in tooling (e.g., welding equipment, training, etc.). Such a roller assembly process also requires two welds to adequately connect hook tape onto the roller body and a significant amount of dwell time. As such, roller assemblies in which hook tape is welded onto a roller body have a slow assembly rate. Moreover, the process of welding hook tape directly onto a roller body often melts and/or damages the roller body, resulting in discoloration of the roller assembly and an overall unaesthetic or unappealing roller assembly.

There is a need to provide a roller assembly with hook tape that can be rapidly and efficiently assembled without extensive tooling. There is also a need to provide a commercially appealing roller assembly with hook tape.

Accordingly, an object of the present invention is to provide a roller assembly with hook tape that can be rapidly and efficiently assembled.

It is a further object of the present invention to provide a roller assembly with hook tape that can be assembled without extensive tooling.

Another object of the present invention is to provide a roller assembly with hook tape that is commercially appealing.

SUMMARY OF THE INVENTION

The present invention is a roller assembly that employs a mechanical arrangement to clamp or connect hook tape onto a roller body. In this way, hook tape can be rapidly and efficiently connected onto the roller body without extensive tooling and, moreover, without welding the hook tape directly onto the roller body. Such an arrangement avoids the problems associated with welding the hook tape directly onto the roller body (e.g., damage or deformation of the roller body and discoloration of the roller assembly) and provides a commercially appealing roller assembly.

In a first embodiment of the present invention, there is provided a roller assembly comprising a roller body including a bore therein and a slot communicating between an exterior surface portion of the roller body and the bore. A hook tape is wrapped around the roller body and includes a first tape end and a second tape end. The first tape end and the second tape end extend into the bore through the slot. A key (e.g., a roller core) is positioned in the bore and clamps the first tape end and the second tape end, thereby securing the hook tape to the roller body.

In a second embodiment, a roller body includes a slot on an exterior surface portion. A hook tape is wrapped around the roller body and includes a first tape end and a second tape end. The first tape end and the second tape end are positioned in the slot. At least one key is positioned in the slot and clamps the first tape end and the second tape end, thereby securing the hook tape to the roller body.

In a third embodiment of a roller body has at least one pin extending from an exterior surface portion. A hook tape is wrapped around the roller body and includes a first tape end and a second tape end. The first tape end and the second tape end are connected to the pin to thereby secure the hook tape to the roller body. A portion of the first and second tape ends may also be welded together to ensure that the hook tape is securely connected to the roller body.

BRIEF DESCRIPTION OF THE PREFERRED EMBODIMENTS

DETAILED DESCRIPTION OF THE PREFERRED EMBODIMENTS

Figure 1:
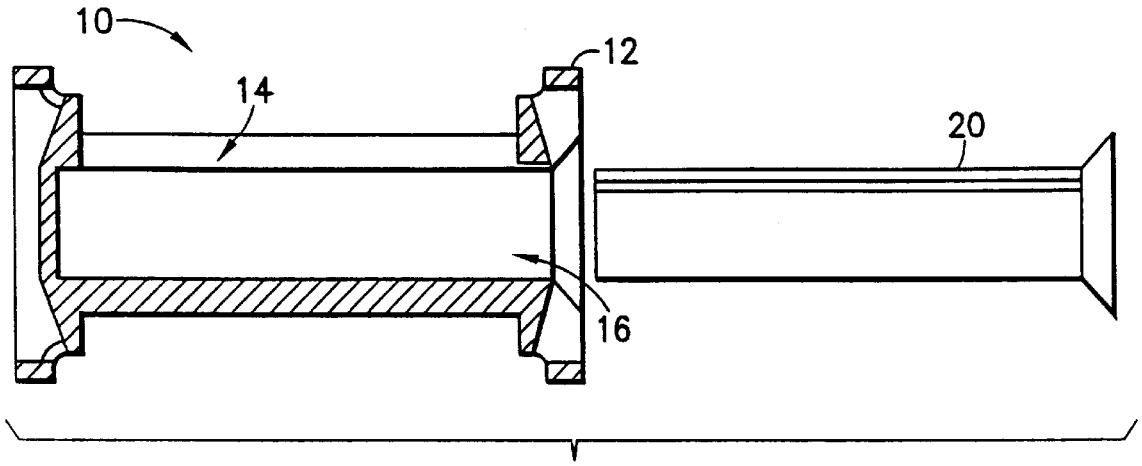
FIGS. 1 through 3 illustrate a first embodiment of a roller assembly with hook tape connected to a roller body.

Referring to FIGS. 1 through 5, there is provided a first embodiment of a roller assembly 10, which includes a roller body 12, hook tape 30 wrapped around the roller body and a key 20 for clamping or securing the hook tape to the roller body. Roller body 12 includes a bore 16 and a slot 14 which communicates between an exterior surface portion of the roller body and bore 16. Roller body 12 preferably has an approximately cylindrical shape. Hook tape 30 is wrapped around roller body 12 and includes a first tape end 32 and a second tape end 34 (FIGS. 4 and 5) which extend through slot 14 and into bore 16. A key 20 (e.g., a roller core) is adapted to engage bore 16 of roller body 12 to clamp first end tape 32 and second end tape 34 against an interior surface of the bore to secure hook tape 30 to roller body 12.

Key 20 preferably includes a raised member 24 (FIG. 5) that extends at least partially along a center-line axis of the key and is adapted to extend partially into slot 14 when key 20 is inserted into bore 16. A groove 22 is positioned on opposite sides of raised member 24 and is adapted to receive first tape end 32 and second tape end 34, respectively, when key 20 is inserted into bore 16. Each groove has extending therefrom at least one clamping member 26 (e.g., teeth, protrusions or the like) for clamping tape ends 32, 34 against an interior surface of bore 16. Raised member 24 allows for simple alignment of grooves 22 with respective tape ends 32, 34 when key 20 is inserted into bore 16.

Figure 2:
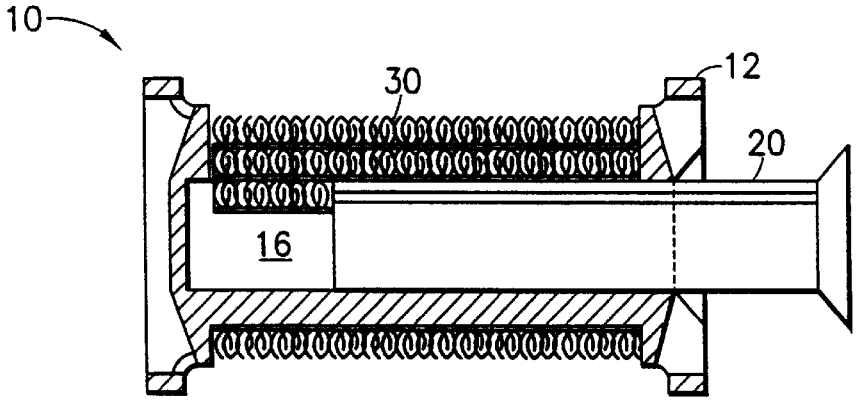
Figure 3:
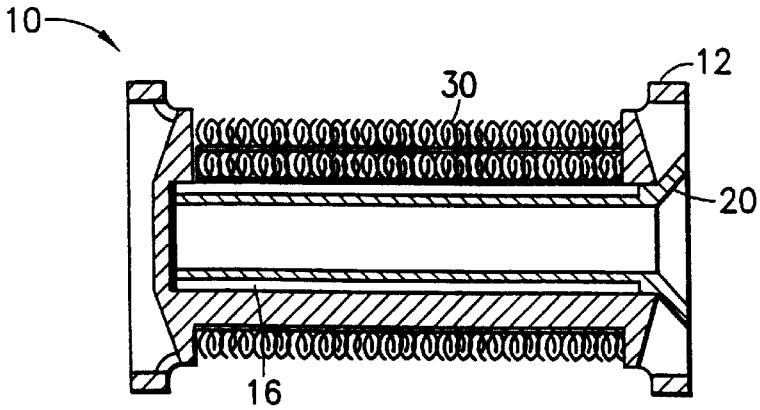
Figure 4:
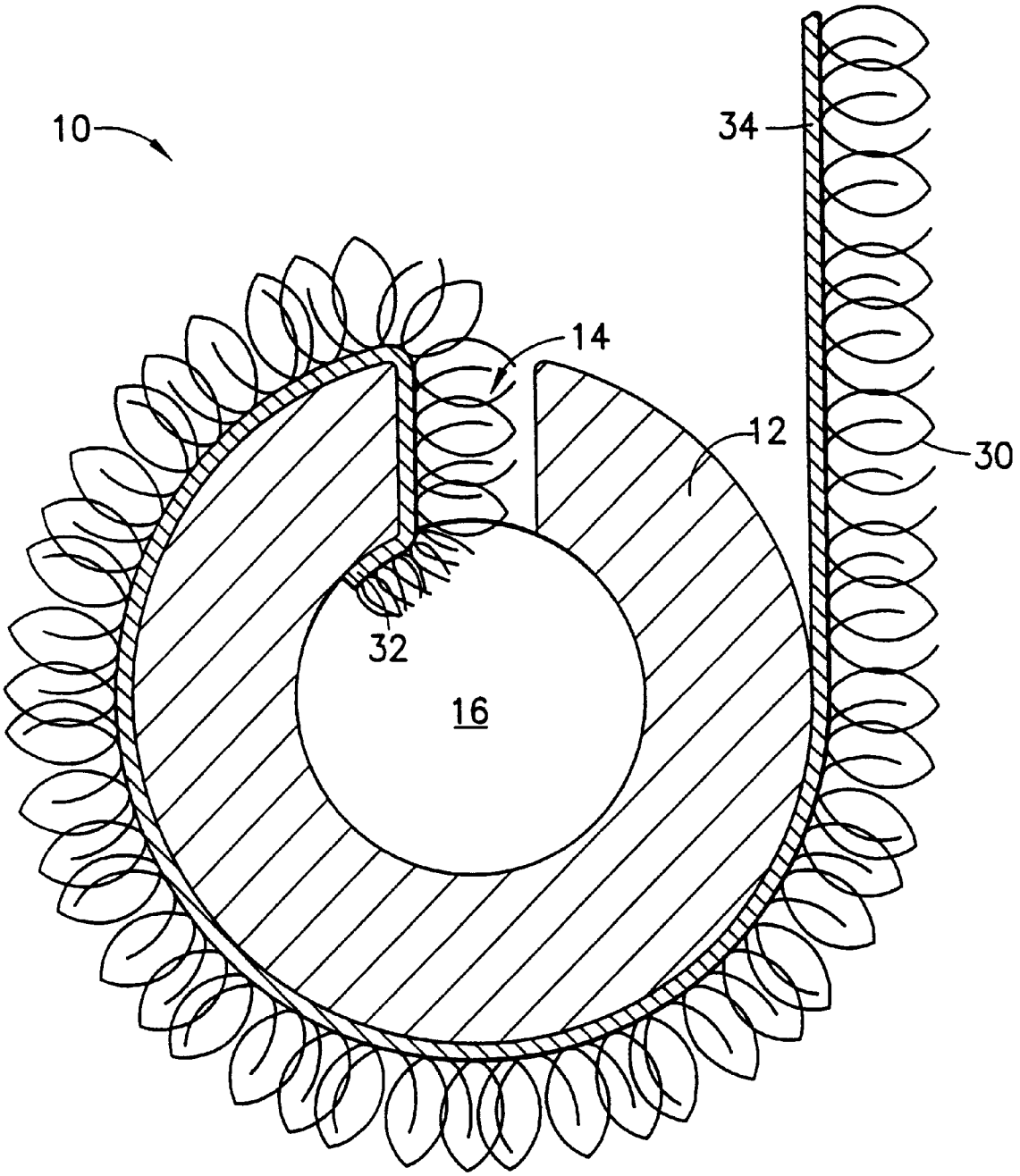
FIG. 4 illustrates a cross-sectional view of one end of a hook tape positioned in a bore of a roller body, in accordance with the first embodiment of the present invention.
Figure 5:
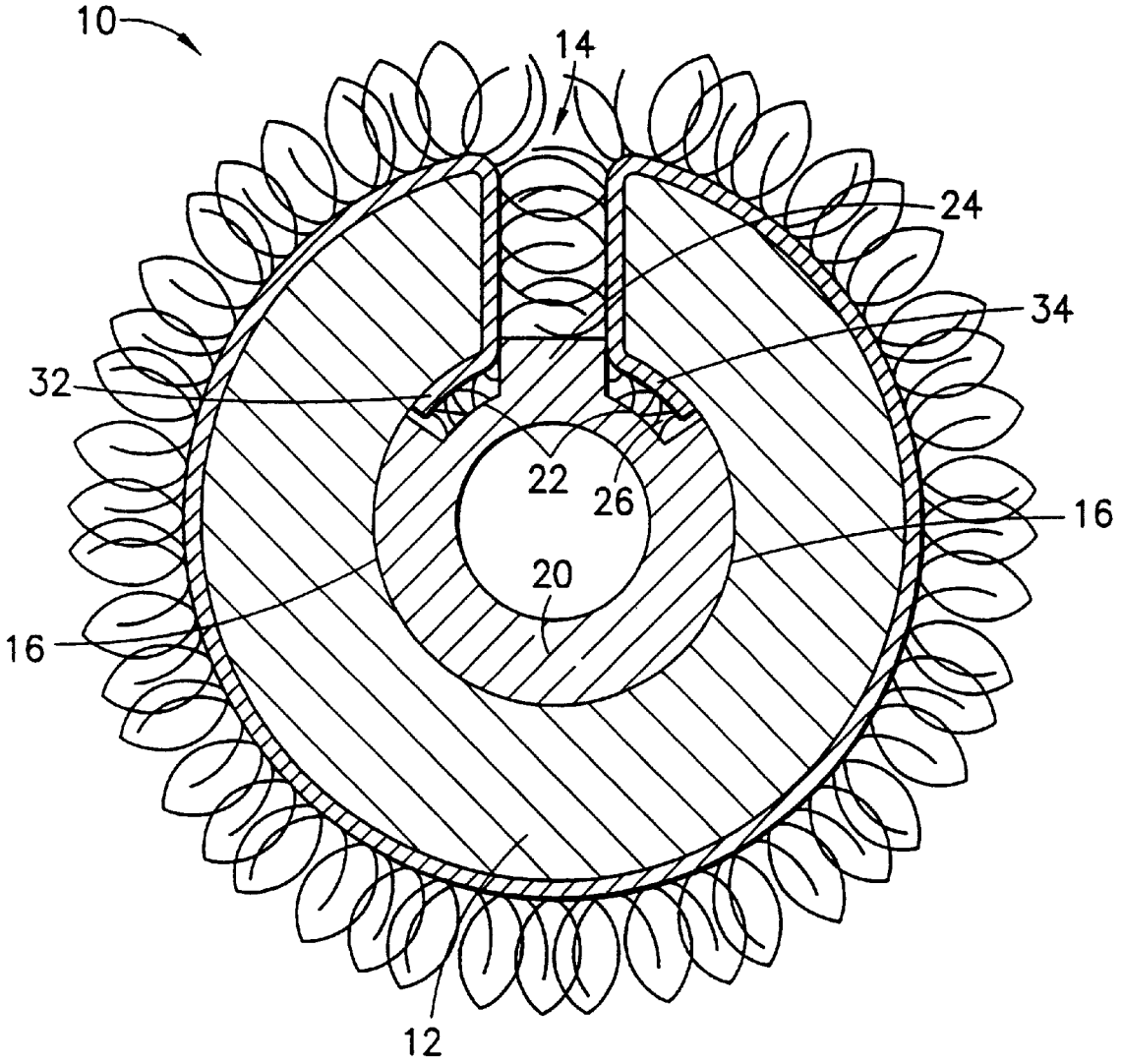
FIG. 5 illustrates a cross-sectional view of an assembled roller assembly of FIG. 1, in accordance with the first embodiment of the present invention.

An example of a preferred assembly process of roller assembly 10 is provided herein. Initially, first tape end 32 of hook tape 30 is inserted into bore 16 through slot 14, as shown in FIGS. 2 and 5. Hook tape 30 is then wrapped around roller body 12, and second tape end 34 is inserted into bore 16 through slot 14. Thereafter, raised member 24 of key 20 is aligned with slot 14 of roller body 12, and the key is inserted into bore 16, with each groove 22 of the key receiving respective tape ends 32, 34 (FIG. 2). Key 20 is inserted into bore 16 until the key is completely engaged in roller body 12 (FIGS. 3 and 5). As shown in FIG. 5, key 20 clamps first tape end 32 and second tape end 34 of hook tape 30 against a surface of bore 16 to prevent removal of the hook tape from roller body 12.

Although the above describes a preferred roller assembly 10 and preferred method of assembling the roller assembly, alternative arrangements may be employed to accomplish the same. For example, hook tape 30 can be wrapped around roller body 12 and first tape end 32 and second tape end 34 of the hook tape can then be inserted into bore 16 through slot 14. Key 20 can be configured in any suitable shape or size to engage bore 16 to clamp first tape end 32 and second tape end 34 to secure hook tape 30 to roller body 12.

Figure 6:
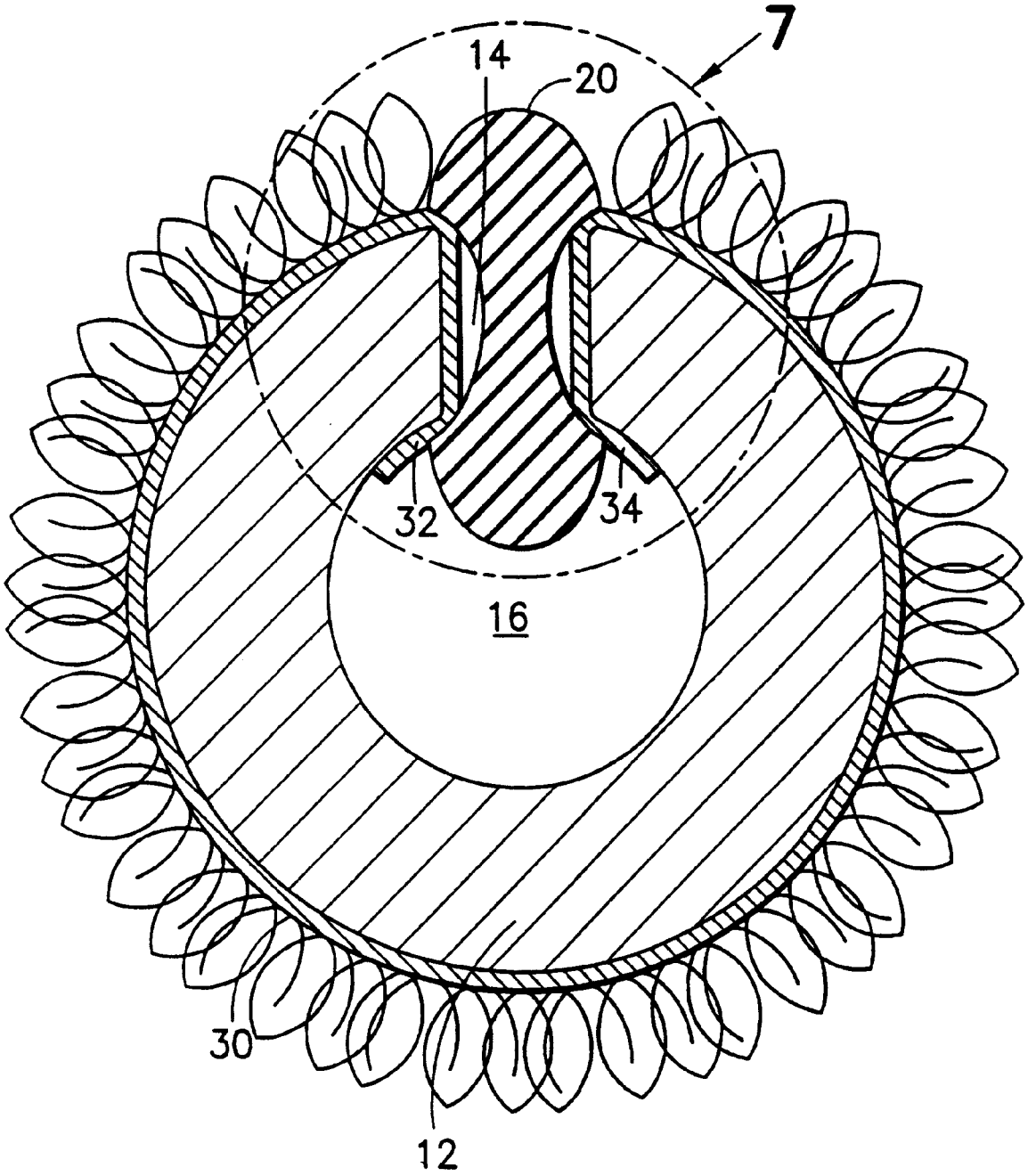
FIG. 6 illustrates a cross-sectional view of a roller assembly in which a key (e.g., with a dumb-bell shape) is positioned in a slot of a roller body to secure hook tape to the roller body, in accordance with a second embodiment of the present invention.
Figure 7:
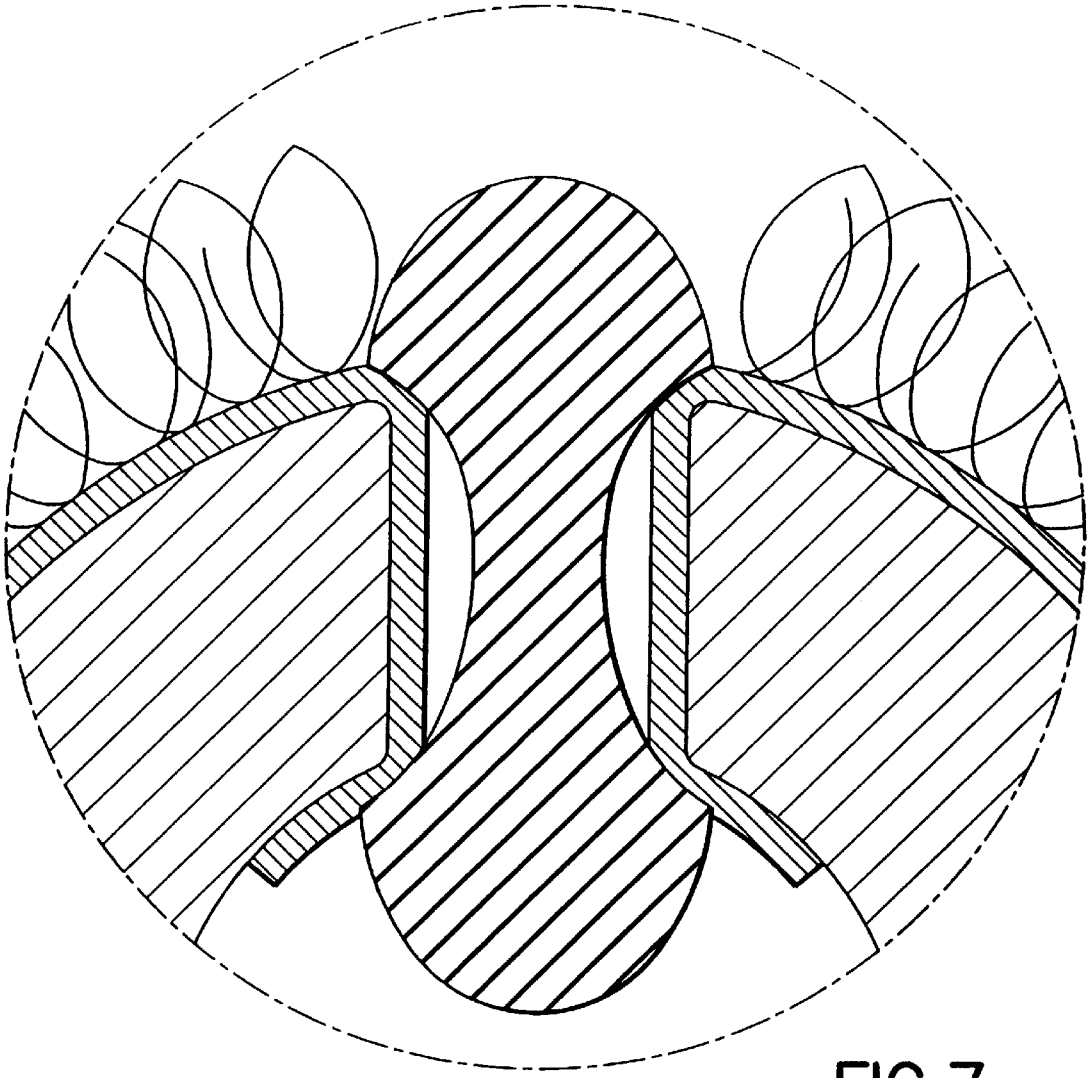
FIG. 7 illustrates an enlarged view of a portion of the roller assembly of FIG. 6 in which a key (e.g., with a dumb-bell shape) is positioned in a slot of the roller body.

Referring to FIGS. 6 and 7, there is provided a second embodiment of roller assembly 10 in which hook tape is clamped in a slot of a roller body to connect the hook tape to the roller body. In this embodiment, roller assembly 10 includes roller body 12 having bore 16 and a slot 14 that communicates between an exterior surface portion of roller body 12 and bore 16. Hook tape 30 is wrapped around roller body 12 and includes first tape end 32 and second tape end 34, each of which have at least a portion thereof positioned in slot 14. Key 20 is adapted to fit into slot 14 to clamp first tape end 32 and second tape end 34 against a surface of the slot, thereby securing hook tape 30 to roller body 12. In this embodiment, key 20 preferably has a dumbbell shape or tapers towards a center of the key. Although only one key 20 is shown in FIGS. 6 and 7, roller assembly 10 may include a plurality of keys, preferably positioned at spaced-apart intervals along slot 14.

Figure 8:
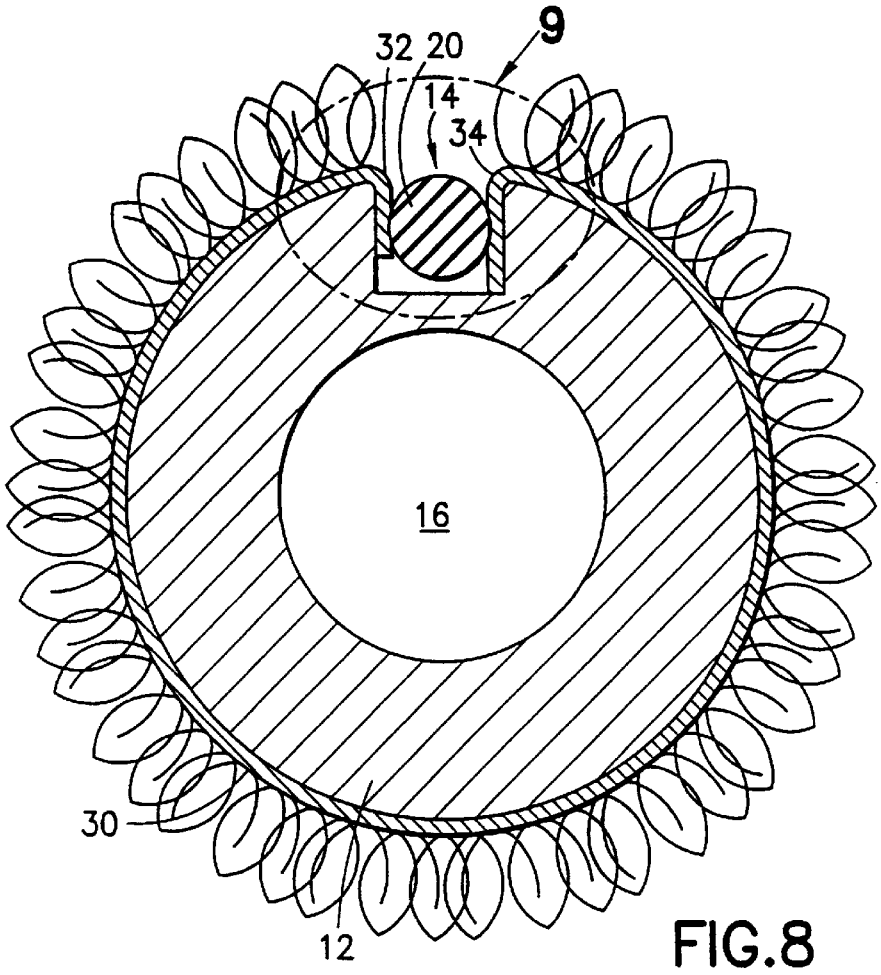
FIG. 8 illustrates a cross-sectional view of another roller assembly in which a key (e.g., a bead or the like) is positioned in a slot of a roller body to secure hook tape to the roller body, in accordance with a second embodiment of the present invention.
Figure 9:
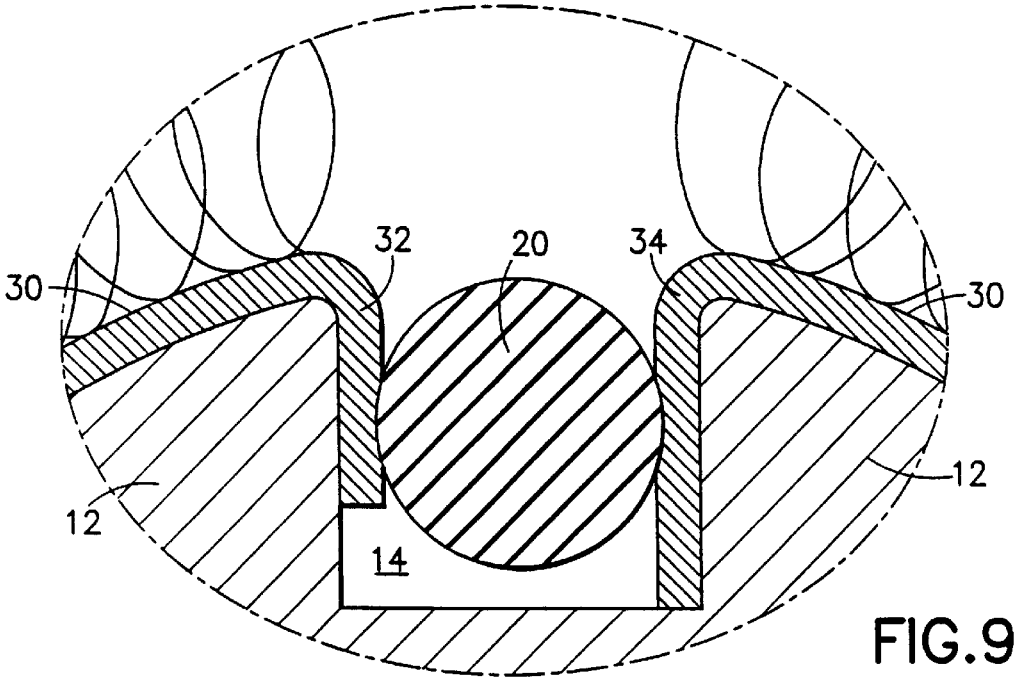
FIG. 9 illustrates an enlarged view of a portion of the roller assembly of FIG. 8 in which a key (e.g., a bead or the like) is positioned in a slot of the roller body.
Figure 10:
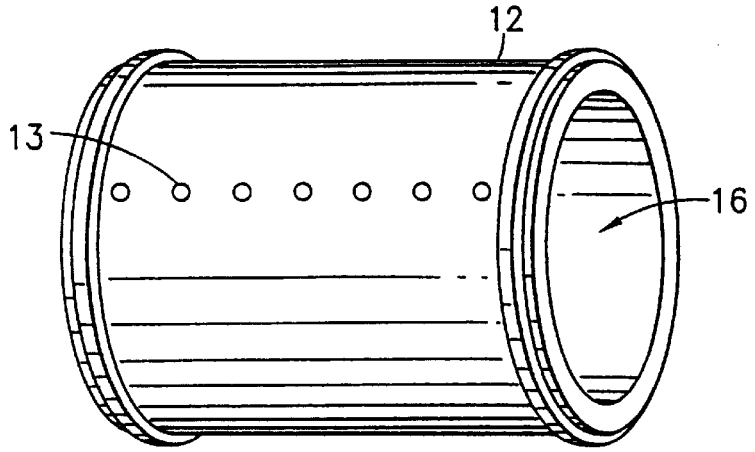
FIG. 10 illustrates a roller body including at least one pin, but preferably a plurality of pins, extending from an exterior surface of the roller body, in accordance with a third embodiment of the present invention.
Figure 11:
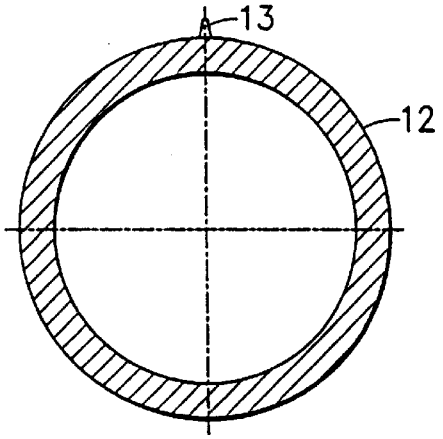
FIG. 11 illustrates a cross-sectional view of the roller body of FIG. 10, wherein the pin(s) extends at about 180 degrees from a center-line of the roller body.

FIGS. 8 and 9 illustrate a further embodiment for clamping first tape end 32 and second tape end 34 in slot 14. In this arrangement, roller body 12 includes slot 14, which extends along an exterior surface of roller body 12, and may include a bore 16. Key 20 is adapted to engage slot 14 to clamp tape ends 32, 34 against a surface of the slot, thereby securing hook tape 30 to roller body 12. Key 20 may have a circular, elliptical, oval or cylindrical shape (e.g., a bead) or any size or shape that is suitable for clamping tape ends 32, 34 in slot 14.

To better understand the second embodiment of the present invention, there is provided below an example of assembly operation of roller assembly 10. Initially, hook tape 30 is wrapped around roller body 12, with at least a portion of tape ends 32, 34 positioned in slot 14. At least one key 20 is then inserted into slot 14 between tape ends 32, 34. Key(s) 20 clamps tape ends 32, 34 against a surface of slot 14 to thereby prevent removal of hook tape 30 from roller body 12.

Turning to a third embodiment of the present invention, FIGS. 10 through 16 illustrate a roller assembly 10 which employs pins to connect hook tape to a roller body. Roller assembly 10 includes a roller body 12 having at least one pin 13 extending from an exterior surface. Hook tape 30 is wrapped around roller body 12 and includes first tape end 32 and second tape end 34, which are connected to the roller body, across pin 13. Each tape end 32, 34 may include at least one opening, slot, slit or the like (not shown) for engaging pin 13.

Figure 12:
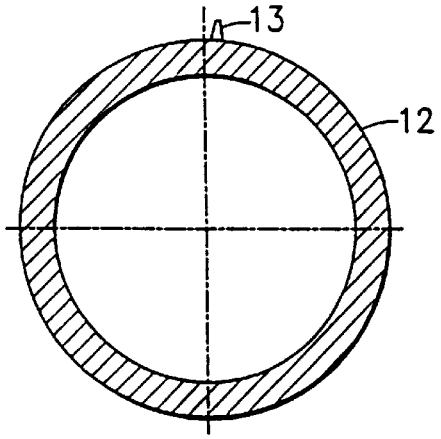
FIG. 12 illustrates a cross-sectional view of the roller body of FIG. 10, wherein the pin(s) extends at about 5 degrees from a center-line of the roller body.

Roller body 12 preferably includes a plurality of spaced-apart pins 13 arranged along a center-line axis of the roller body. Pins 13 may extend from the exterior surface of roller body 12 at about 180 degrees from a center-line of the roller body (FIG. 11) or at about 5 degrees from a center-line of roller body 12 (FIG. 12). Pins 13 may be connected to roller body 12 or integral to roller body 12 (e.g., molded as part of the roller body). The preferred pin arrangements will be described below with reference to FIGS. 13 through 16.

Figure 13:
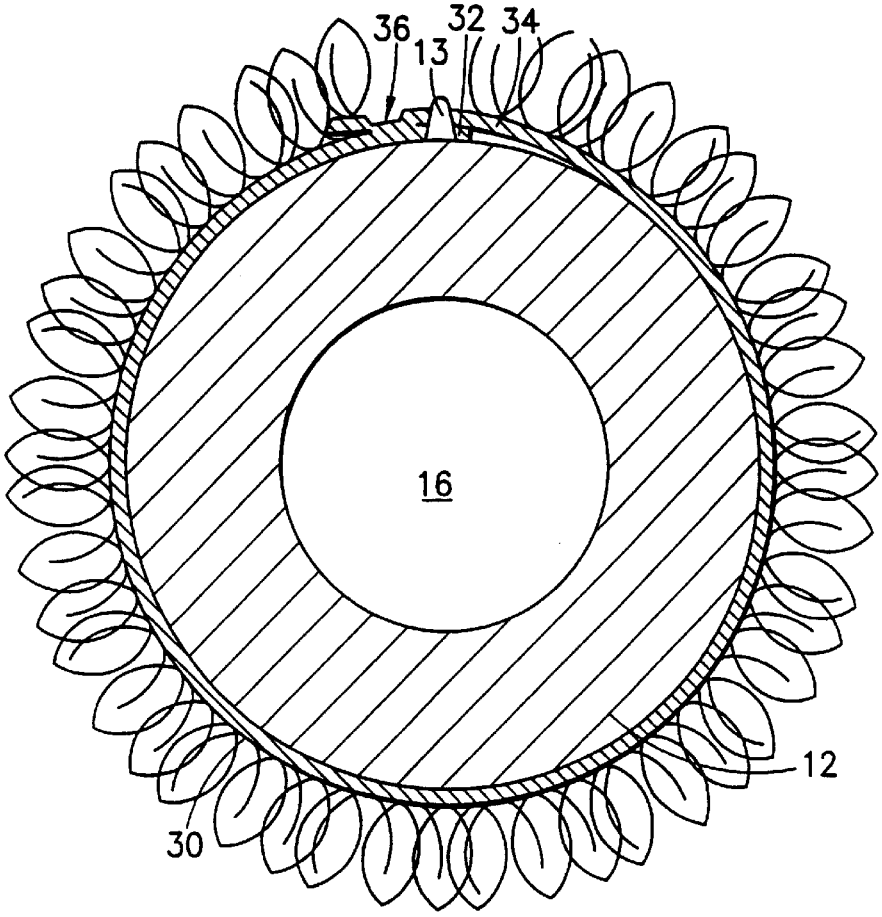
FIG. 13 illustrates a roller assembly with hook tape connected to the roller body of FIG. 10 across triangular-shaped or tapering-shaped pin(s), in accordance with the third embodiment of the present invention.
Figure 14:
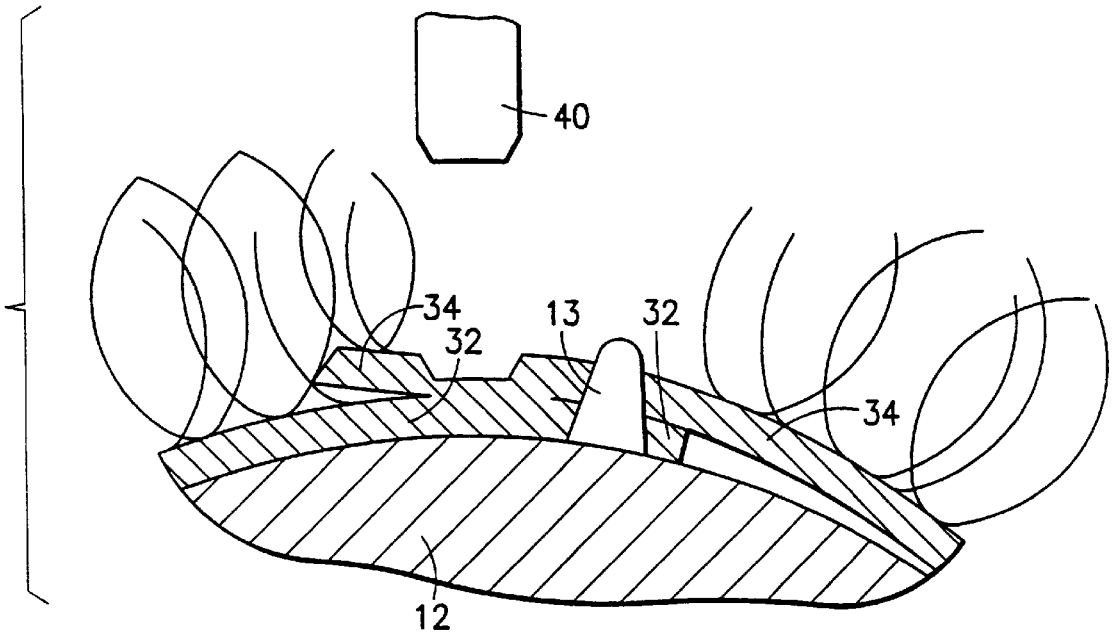
FIG. 14 illustrates an enlarged view of a portion of the roller assembly of FIG. 13 with a first and second end of the hook tape connected to the roller body, across the triangular-shaped or tapering-shaped pins, and a portion of the first and second ends welded together.

FIGS. 13 and 14 illustrate roller body 12 including pin(s) 13 that extend from an exterior surface of the roller body and taper as they extend away from the roller body (e.g., triangular shape, parabolic shape or the like). Hook tape 30 includes first tape end 32 which is connected or inserted onto pin 13 and second tape end 34 which is connected or inserted onto pin 13 over the first tape end. A portion of tape ends 32, 34 generally indicated by the reference numeral 36 are welded together through the use of known welding techniques. This ensures that hook tape 30 remains securely connected on roller body 12, across pin 13. A welding device 40 is generally shown in FIG. 14 for welding a portion of tape ends 32, 34 together. Roller body 12 may include bore 16, if desired, for receiving a roller core.

Figure 15:
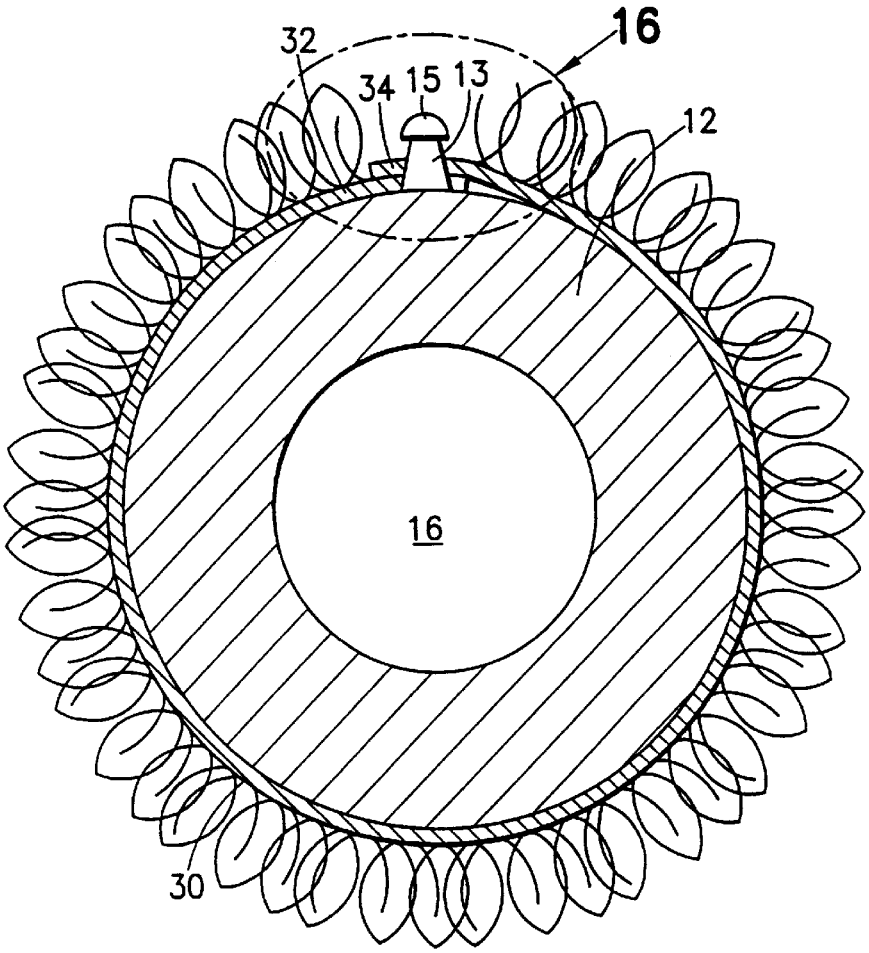
FIG. 15 illustrates another roller assembly with hook tape connected to the roller body of FIG. 10 across mushroom-shaped pin(s), in accordance with the third embodiment of the present invention.
Figure 16:
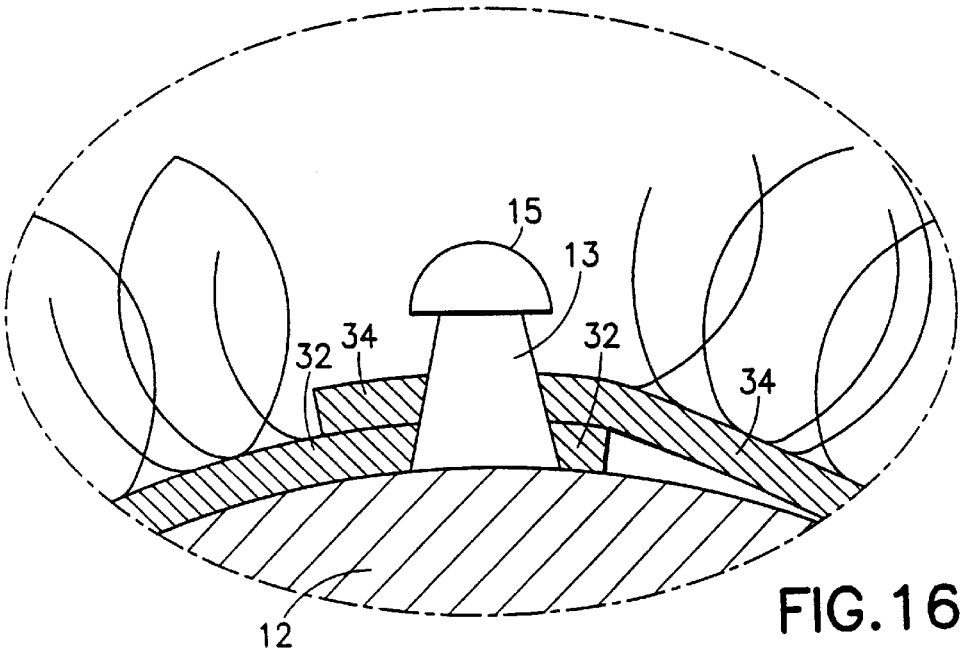
FIG. 16 illustrates an enlarged view of a portion of the roller assembly of FIG. 15 with a first and second tape end of the hook tape connected to the roller body across the mushroom-shaped pin(s).

FIGS. 15 and 16 illustrate another pin arrangement of the third embodiment. As shown, pin 13 includes means for preventing removal of hook tape 30 from roller body 12. In particular, roller body 12 includes at least one pin 13 that extends from the roller body. Hook tape 30 is wrapped around roller body 12, with first tape end 32 connected onto pin 13 and second tape end 34 connected onto pin 13 over the first tape end. Pin 13 includes a cap-like protrusion 15 at an end away from the roller body for preventing removal of hook tape 30 from the pin. Pin 13 may be swaged to form cap-like protrusion 15 after hook tape 30 is connected onto pin 13. It should be understood that protrusion 15 may take any suitable form, which prevents removal of the hook tape from pin 13.

To better understand the third embodiment of the present invention, there is provided below an example of assembly operation of roller assembly 10. Initially, first tape end of hook tape 30 is connected or inserted onto pin 13. Hook tape 30 is then wrapped around roller body 12 and second tape end 34 is connected or inserted onto pin 13 over first tape end 32. Alternatively, hook tape 30 can be wrapped around roller body 12 and both tape ends 32, 34 can be inserted or connected onto pin 13 at the same time. As a further measure, a portion of tape ends 32, 34 can then be welded together to ensure that hook tape is securely connected to roller body 12.

In summary, the present invention provides a roller assembly with hook tape that can be rapidly assembled without extensive tooling. The present invention further provides a roller assembly with hook tape that avoids the problems associated with welding the hook tape directly onto the roller body (e.g., deformation, discoloration, commercially unappealing, etc.).

The invention having thus been described with particular reference to the preferred forms thereof, it will be obvious that various changes and modifications may be made therein without departing from the spirit and scope of the invention as defined in the appended claims.

We claim:

1. A roller comprising:

a roller body including a bore therein and a slot communicating between an exterior surface portion of said roller body and said bore;

hook tape wrapped around said roller body and including a first tape- end and a second tape end, said first tape end and said second tape end extending into said bore through said slot; and a key positioned in said bore for clamping said first tape end and said second tape end.

2. The roller of claim 1, wherein said key includes grooves for receiving said first end and said second end and clamping said first end and said second end against and interior bore surface of said roller body.

3. The roller of claim 1, wherein said roller body is approximately cylindrical.

4. A method for connecting hook tape to a roller body, wherein said roller body includes a bore therein and a slot communicating between an exterior surface portion of said roller body and said bore and said hook tape includes a first tape end and a second tape end opposite said first tape end, the method comprising the steps of:

(a) wrapping said hook tape around said roller body, with said first tape end and said second tape end extending into said roller bore through said roller slot; and (b) inserting a key into said bore of said roller body to clamp said first tape end and said second tape end.

5. The method of claim 4, wherein said step (a) includes the steps of:

inserting said first tape end into said bore through said slot;

wrapping said hook tape around said roller body; and inserting said second tape end into said bore through said slot.

6. The method of claim 4, wherein said key clamps said first tape end and said second tape end against an interior surface of said roller body.

7. The method of claim 4, wherein said key includes grooves adapted to receive and clamp said first tape end and said second tape end in said bore.

8. A roller comprising:

a roller body including a slot on an exterior surface portion of said roller body;

hook tape wrapped around said roller body and including a first tape end and a second tape end, said first tape end and said second tape end positioned in said slot; and at least one key positioned in said slot for clamping said first tape end and said second tape end.

9. The roller of claim 8, wherein said at least one key is a bead.

10. The roller of claim 8, wherein said at least one key has a dumb-bell shape.

11. The roller of claim 8, wherein said roller body includes a bore therein and said slot communicates between an exterior surface portion of said roller body and said bore.

12. The roller of claim 8, wherein said at least one key is positioned in said slot between said first tape end and said second tape end and clamps said first tape end and said second tape end against a surface of said slot.

13. A method for connecting hook tape to a roller body, wherein said roller body includes a slot on an exterior surface portion of said roller body and said hook tape includes a first tape end and a second tape end opposite said first tape end, the method comprising the steps of:

(a) wrapping said hook tape around said roller body, with said first tape end and said second tape end positioned in said slot; and (b) inserting at least one key into said slot to clamp said first tape end and said second tape end.

14. The method of claim 13, wherein said step (a) comprises the steps of:

inserting said first tape end into said slot;

wrapping said hook tape around said roller body; and inserting said second tape end into said slot.

15. A roller comprising:

a roller body including at least one pin extending from an exterior surface portion of said roller body; and hook tape wrapped around said roller body and including a first tape end and a second tape end, said first tape end and said second tape end connected to said at least one pin, said at least one pin including means for preventing removal of said first tape end and said second tape end from said pin.

16. The roller of claim 15, wherein said roller body includes a plurality of pins, said hook tape being wrapped around said roller body, with said first tape end and said second tape end being secured to said pins.

17. The roller of claim 15, wherein said at least one pin extends from said exterior surface at about 5 degrees from a center-line of said roller body.

18. The roller of claim 15, wherein said at least one pin extends from said exterior surface at about 180 degrees from a center-line of said roller body.

19. The roller of claim 15, wherein said at least one pin includes a protruding portion at an end of said pin opposite said roller body, said protruding portion preventing removal of said first tape end and said second tape end from said at least one pin.

* * * * *